US005450973A

United States Patent [19]

Ellis et al.

[11] Patent Number: 5,450,973

[45] Date of Patent: Sep. 19, 1995

[54] TAMPER-EVIDENT CLOSURE APPARATUS

[75] Inventors: John D. Ellis, Cranford; Daniel Mattia, Union, both of N.J.

[73] Assignee: Eagle Engraving and Mold Corp., Clark, N.J.

[21] Appl. No.: 310,427

[22] Filed: Sep. 22, 1994

[51] Int. Cl.[6] ..... B65D 41/34

[52] U.S. Cl. ..... 215/252; 215/344; 215/354

[58] Field of Search ..... 215/252, 344, 354

[56] References Cited

U.S. PATENT DOCUMENTS

| | | | |
|---|---|---|---|
| 4,090,631 | 5/1978 | Grussen | 215/329 |
| 4,511,053 | 4/1985 | Brandes et al. | 215/252 |
| 4,550,844 | 11/1985 | Lininger . | |
| 4,732,289 | 3/1988 | Granat et al. . | |
| 4,784,280 | 11/1988 | Breuer et al. | 215/252 |
| 4,801,030 | 1/1989 | Barriac . | |
| 4,801,031 | 1/1989 | Barriac . | |
| 4,813,561 | 3/1989 | Ochs | 215/252 |
| 4,978,017 | 12/1990 | McBride . | |
| 4,997,097 | 3/1991 | Krautkramer | 215/307 |
| 5,007,545 | 4/1991 | Imberry, Jr. . | |
| 5,096,079 | 3/1992 | Odet . | |
| 5,131,069 | 7/1992 | Ingram et al. . | |
| 5,167,335 | 12/1992 | McBride et al. | 215/252 |
| 5,346,082 | 9/1994 | Ochs et al. | 215/252 |
| 5,356,019 | 10/1994 | Kelly | 215/252 |

*Primary Examiner*—Stephen P. Garbe

*Assistant Examiner*—Vanessa Caretto

*Attorney, Agent, or Firm*—Plevy & Associates

[57] ABSTRACT

A tamper indicating closure comprising a one-piece molded plastic closure which threads onto the finish of a container such that when the closure is removed from the container, a tamper indicating band becomes separated from a lower end of a cap member of the closure. The tamper indicating band is joined to the closure along a weakened frangible line. The band includes a flexible Y-shaped annular flap segmented into tabs and attached to the lower end of the annular tamper band. When the closure is applied to the container, the annular band folds radially inward and up toward the cap member. The interior surface of the band and the first leg of the annular band include corresponding ratchet teeth which are designed to accommodate a varying degree of finish tolerances and which engage upon removal of the cap from the container. A second leg of the annular flap extends outwardly beneath a peripheral bead on the finish of the container when the closure is fully attached. Upon removal of the closure from the container, the second leg abuts underneath the peripheral bead to create resistance. The ratchet teeth on the band and flap are caused to engage with one another while the first leg wedges between the outside edge of the peripheral bead and the skin of the cap member. Further removal of the closure causes the tamper indicating band to sever from the cap member along the weakened line.

21 Claims, 4 Drawing Sheets

TAMPER-EVIDENT CLOSURE APPARATUS

FIELD OF THE INVENTION

The present invention relates to an improved closure member which has tamper indicating means to provide a visual indication when the associated container has been tampered with and more particularly to a tamper indicating closure member having varying finish tolerances.

BACKGROUND OF THE INVENTION

It is known in the art to provide tamper proof closures for containers which provide a visual indication of tampering. For example, there is provided, a closure with an interconnected annular band which is detachable from the closure upon first removal of the closure from a container. Such bands normally include a means which engages with a portion of the neck of the container, thus restricting axial movement of the band from the neck of the container once placed in position. Difficulties have been encountered with the use of such tamper evident closures when used on containers manufactured within the limits of normal dimensional tolerances. It has been found that with manufacturing variation of the container neck, within allotted tolerances, difficulties are encountered for larger and smaller toleranced container necks. Thus, if the diameter of the container neck is too large, there are difficulties in placing the tamper proof closure onto the container. Alternatively, if loosely fitted, the closure can be removed from the container without severing the band portion. In the past this difficulty due to variation within normal tolerances has necessitated the utilization of expensive manufacturing methods for containers to be used with such closure members.

Patents in the prior an have attempted to address this problem. For example, U.S. Pat. No. 4,732,289 to Granat et al. entitled TAMPER INDICATING CLOSURE MEMBER FOR CONTAINER issued Mar. 22, 1988 describes a tamper indicating closure having a tamper band with an annular flap which folds up along an inner surface of the tamper band when the closure is applied to a container. When an attempt is made to unscrew the closure, the tamper band is resisted by the annular flaps which abut under a portion of an annular bend on the neck of the container. The resistance from the bend provided on the flaps is intended to separate the tamper band from the closure. Because of the varying tolerances of the containers, however, it is possible to manipulate the flaps of the tamper band in order to remove the closure without activating the tamper mechanism.

U.S. Pat. No. 5,310,069 to Ingram et al. entitled TAMPER INDICATING PACKAGE and issued on May 10, 1994 discloses a tamper indicating package comprising a container having a neck with a threaded finish, an annular bead on the neck, a plastic closure which includes a base wall and a depending peripheral skin having threads interengaging the threads of the container, and a tamper indicating band attached to the skirt by a plurality of weakened portions defining a line of severing. An annular flange extends axially upwardly and inwardly from the tamper indicating band toward the base wall of the closure and comprises a first continuous annular flange portion connected to the band by a hinge portion and a second portion which has free ends of the segment portions engaging beneath the bead on the container when the closure is threaded onto the container. In one form, the second portion comprises plurality of segment portions extending upwardly and inwardly from the first continuous portion. In another form, the second portion comprises a second continuous flange portion. The flange is bent intermediate its ends so that the second portion extends inwardly at a greater angle than the first continuous flange portion.

U.S. Pat. No. 4,801,030 to Barriac, entitled TAMPER INDICATING CLOSURE AND PACKAGE discloses a device comprising a one-piece molded closure of plastic which threads onto a container such that when the closure is unthreaded, a tamper-indicating band becomes separated from the lower end of the closure skin. The tamper-indicating band is joined to the closure along a weakened frangible line. A flexible annular wall is formed within the band and extends inwardly and upwardly when the closure is applied to container finish. The band further includes a plurality of circumferentially spaced flexible walls extending circumferentially and fastened at their circumferentially ends to the inner surface of the annular wall and having portions intermediate their ends which extend radially inwardly. When the closure is applied to the container, the intermediate portions of the circumferentially extending walls are flexed radially outwardly intermediate their ends over the annular bead on the container and then flex radially inwardly beneath the annular bead while the annular wall is interposed between the skirt of the closure and the annular bead on the container. When the closure is unthreaded, the upper edges of the circumferentially spaced circumferential walls engage the underside of the bead and cause the band to sever along the weakened line.

The real world problems encountered when dealing with containers having finish areas of varying dimensional tolerances, however, are not adequately addressed. In practical situations the tamper bands of the prior an can be manipulated outward with a small diameter probe or other like object and then over the resisting annular bead of the container in order to defeat the tamper-resistant mechanism.

It is therefore an object of the present invention to provide an improved tamper evident closure member for use with screw-top containers which is adapted for tamper evident operation despite severe dimensional tolerances in the neck of the container.

It is further an object of the invention to provide a completely reliable tamper proof closure which eliminates the possibility of pryable removal over an annular bead on the container without detection.

SUMMARY OF THE INVENTION

The present invention tamper indicating closure comprises a one-piece molded plastic closure which threads onto the finish of a container such that when the closure is removed from the container, a tamper indicating band becomes separated from a lower end of a cap member of the closure. The tamper indicating band is joined to the closure along a weakened frangible line. The band includes a flexible Y-shaped annular flap segmented into tabs and attached to the lower end of the annular tamper band. When the closure is applied to the container, the annular band folds radially inward and up toward the cap member. The interior surface of the band and the first leg of the annular band include corresponding ratchet teeth which are designed to accommodate a varying degree of finish tolerances and which engage upon removal of the cap from the container. A second leg of the annular flap extends outwardly beneath a peripheral bead on the finish of the container when the closure is fully attached. Upon removal of the closure from the container, the second leg abuts underneath the peripheral bead to create resistance. The ratchet teeth on the band and flap are caused to engage with one another while the first leg wedges between the outside edge of the peripheral bead and the skin of the cap member. Further removal of the closure causes the tamper indicating band to sever from the cap member along the weakened line.

An alternate embodiment of the present invention closure includes a rounded protruding hump on the interior surface of the annular band which replaces the ratchet teeth. A corresponding protrusion on the annular flap engages with the protruding hump upon removal of the closure. This causes the closure to sever along the frangible area, thus indicating removal of the closure. A second alternate embodiment includes a circumferential protrusion emanating from the interior of the annular band. The protrusion includes ratchet teeth for variable engagement with the first leg of the annular flap.

BRIEF DESCRIPTION OF THE FIGURES

For a better understanding of the present invention, reference may be has to the following description of an exemplary embodiment thereof, considered in conjunction with the accompanying drawings, in which.

DETAILED DESCRIPTION OF THE DRAWINGS

Figure 1:
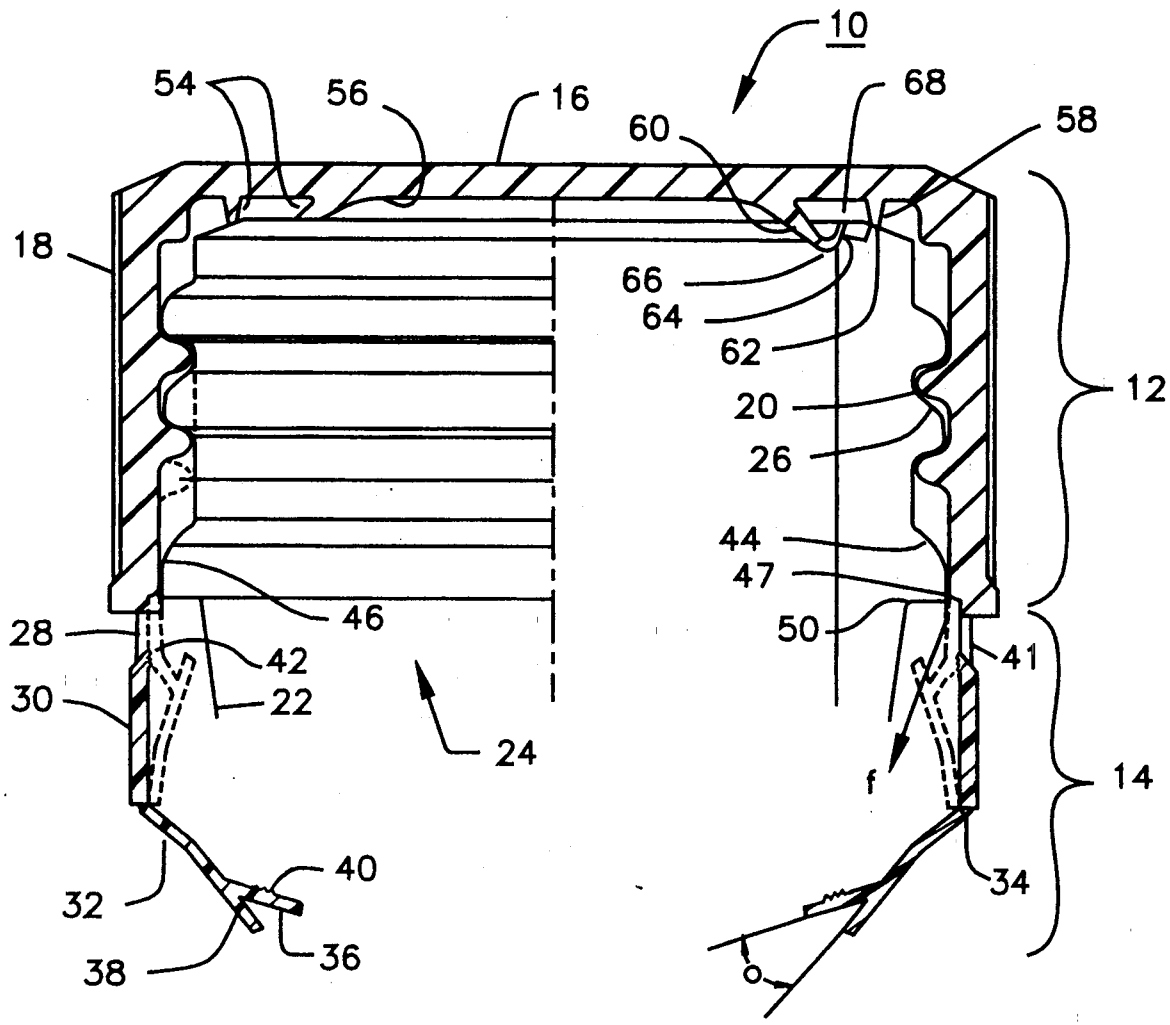
FIG. 1 is a cross-sectional view of a first preferred embodiment of the present invention tamper evident closure.

Referring to FIG. 1 there is shown a first preferred embodiment of a tamper evident closure member 10 according to the present invention. The closure member 10 has a cap member 12 and a band portion 14. The cap member 12 has a top wall 16 with a depending peripheral skirt wall 18. A threaded portion 20 is included on the interior of the skirt wall 18 for engagement and subsequent tightening with the neck 22 of a container 24. It will be understood that the neck 22 of the container 24 will have a threaded portion 26 which corresponds to the threaded portion 20 on the interior of the skin wall 18.

Figure 2:
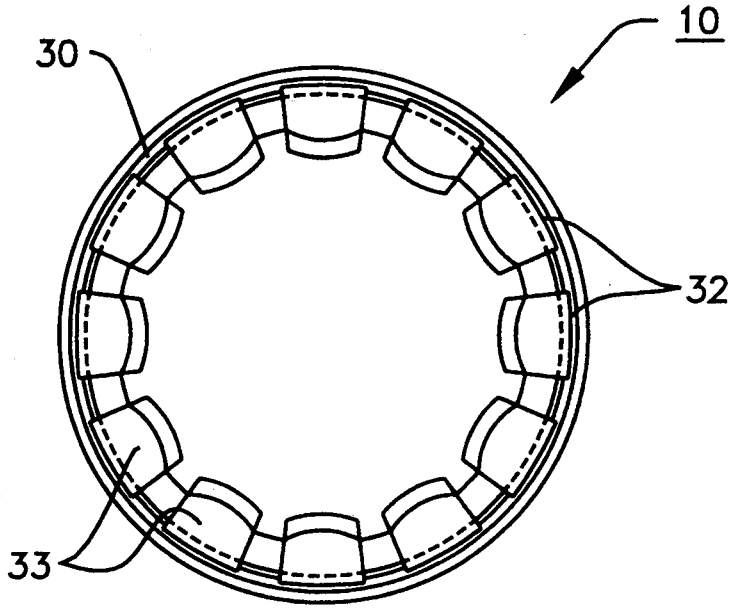
FIG. 2 shows a bottom plan view of the present invention container.

The band portion 14 of the closure member 10 is interconnected to the cap member 12 by means of frangible links or bridge elements 28. The band portion 14 is comprised of an annular band 30 together with annular flap 32. The annular flap 32 is a flexible component hingedly connected at hinge line 34 to the bottom portion of the annular band 30 and is directed radially inward as formed. Referring to FIG. 1 in conjunction with FIG. 2, the preferred embodiment of the present invention closure illustrates the annular flap 32 as a series of tabs 33 equally spaced about the circumference of the annular band 30. It will be understood, however, that the annular flap 32 may take on any suitable form, as for example, a continuous flap or a flap containing lug portions.

Annular flap 32 is essentially a Y-like structure having a first leg 36 and a second leg 38. As shown in FIG. 1, the inner surface of the first leg 36, toward the bottom of annular flap 32, contains jagged protrusions or ratchet teeth 40 which are oriented angularly upward. It will be noted that the second leg 38 of the annular flap 32 does not extend quite as far downward as does the first leg 36.

Looking once again at the annular band 30, it can be seen that the top interior portion 41 thereof proximate the frangible bridge elements 28 also contains ratchet teeth 42. It will be seen that the ratchet teeth 42 of the annular band 30 are adapted to correspond and interlock with the ratchet teeth 40 of the annular flap 32 upon attachment of the closure 10 to the container 24.

From FIG. 1, it can be seen that upon receipt of closure member 10 onto the container 24, the annular flap 32 engages the container neck 22 and then a ramp portion 44 defined by a lower peripheral bead 46. If the flap 32 has not already done so, tightening of the closure 10 onto the neck 22 of the container 24 causes each of the tabs 33 of the annular flap 32 to further engage the peripheral bead 46 and eventually flip upward toward the cap member 12, (as shown in dotted lines). Upon tightening of the closure 10 the first and second legs 36,38 of the annular flap are compressed against the annular band 30, wherein the legs deform to allow further tightening to proceed.

As the closure 10 is tightened, the orientation of the second leg 38 of the Y-structure flap 32 will exert pressure to force the first leg 36 towards the annular band 30. The annular flap 32 is dimensioned so that upon final tightening of the closure 10 to the container 24, the first leg 36 of the annular flap will remain wedged between the top portion of the annular band 30 and the peripheral bead on the container 24. Once the second leg 38 has cleared the peripheral bead 46 the leg 38 will expand radially inward toward the neck 22 of the container 24, the ratchet teeth of the first leg 36 of the Y-structure flap 32 will then align and coact with the corresponding ratchet teeth 42 located on the annular band 30. When the closure has been fully tightened onto the neck 22 of the container 24, the peripheral bead 46, in conjunction with the annular flap 32 and band 30, prevent closure member 10 from being removed without severing the frangible link or bridge elements 28.

It will be seen that, once the closure member 10 has been fitted to the neck 22 of the container 24, unscrewing closure member 10 for the first time will be resisted by the annular flap 32 as it abuts against the peripheral bead 46. Ratchet teeth 42 on the inside of the annular band 30 and the first leg 36 of the annular flap 32 lock together as removal of the closure 10 is initiated. This causes the first leg 36 of the annular flap 32 to jam between the lower outer portion 47 of the peripheral bead 46 and the inside diameter of the skin wall 18 of the cap member 14 preventing the annular band 30 and entire band portion 14 from axial movement, i.e., rolling over or moving up over the peripheral bead 46. The inner and second leg 38 of the Y-structure flap 32 will also engage a lower ridge 50 of the peripheral bead 46 and jam thereunder. An inner downward force F is thus exerted on the inner surface of the annular band 30. As a result of the pressure or force F caused by the engagement of the ratchet teeth components 42 on the annular band 30, the frangible bridge elements 28 are caused to expand and fracture thus exposing the band portion 14 to evidence of tampering or removal of the cap region 12.

The closure 10 is especially suited-to resist tampering, as for example an attempt to pry the band portion 14 off the container 24 with a screwdriver or other insertion means. This is because the greater the forces are exerted on the lower lip of the annular band 30 the greater the forces are in the opposite direction from the second leg 38 of the annular flap 32 to resist the band 30 from peeling over the peripheral bead 46 of the container 24. Similarly the closure 10 prevents the annular band 32 from riding or rolling over the peripheral bead 46 by means of the ratchet teeth arrangement.

Note that the present invention closure 10 is able to accommodate varying degrees of finish tolerances of the container 24. This is because the second leg 38 of Y-structure flap 32 will always engage the lower ridge 50 of the peripheral bead 46, even if the neck 22 of the container 24 is out of tolerance. A suitable number of ratchet teeth on the annular band 30 and first leg 36 of the annular flap 32 will thus ensure engagement. Note that the amount of coverage for out of tolerance containers may be dictated by the alteration of the angle $\theta$ between the first and second legs 36,38 of the Y-structure annular flap 32. A severe increase in the angle $\theta$ will, however, reduce the amount of protection offered by the annular flap 32 and closure package 10.

The present invention closure 10 presents an arrangement wherein the bridge elements 28 between the cap member 12 and band portion 14 are severed upon the initial opening of the container 24. Upon returning the closure to the container, the severing is visibly apparent, thereby indicating a previous opening of the container 24. Preferably, on severing of the bridge elements 28 the band portion 14 is able to fall away from the closure to make the severing visible even when the cap member 12 is returned.

Also included as part of the present invention closure 10 is a unique seal 54 found on the top interior surface 56 of the cap member 12. The seal 54 of the closure 10 is especially suited to the sealing of a beverage or liquid which is preferably kept within a predetermined pressure range. The seal 54 is a two part mechanism comprised of an outer downwardly projecting annular bead 58 and an inner annular hooked flange 60. As can be seen from FIG. 1, the annular bead 58 of the closure 10, when attached, is adapted to coact with an outer peripheral edge 62 of the mouth portion of the container neck 22. The annular hooked flange 60, in turn, flexes slightly upward and engages an inner ledge 64 of the mouth of the container 24. An outer surface of the loop portion 66 of the hooked flange 60 is then biased against the inner ledge 64 of the mouth of the container 24.

When attached, the closure in conjunction with the seal feature 54 maintain a relatively constant pressure within a predetermined range in the interior of the container 24. As pressure increases within the volume of the container 24, a force is exerted on the hooked flange 60 which allows for a slight upward movement of the flange 60 and outgassing of the contents of the container into chamber area 68. When the predetermined pressure is again reached within the inner volume of the container 24, back pressure within the chamber area 68 from the outgas release will force the hook flange 60 again contact the ledge to reform the inner seal. The outer seal created between the annular bead 58 and the peripheral edge 62 of the container 24 will always be maintained thus preventing any release of the contents into the outside environment. Accordingly a unique seal is presented which prevents undesirable pressure build-ups within the interior of a container caused by severe fluctuations in outside temperature, and also eliminating the accompanying negative effects, such as explosion, leakage, etc., while maintaining the integrity of the beverage or liquid stored within. This feature of the closure 10 is especially well suited for the storing of beverages under pressure, for example carbonated beverages and the like.

The closure member 10 of the present invention is preferably made from a suitable material such as a synthetic plastic. The closure 10 is formed using conventional methods, as for example injection molding. The bridge elements 28 which interconnect the skirt of the cap member 12 and the band portion 14 may be of a variety of types. In one form, the elements comprise a frangible, circumferentially extending zone of reduced thickness joining the cap member to the band portion. In an alternative form, there is a plurality of circumferentially spaced bridge elements, each extending axially between and joining the cap member to the band portion. In a preferred embodiment of the invention, the cap member 12 is knurled so as to facilitate gripping and subsequent opening of the closure 10.

Figure 3:
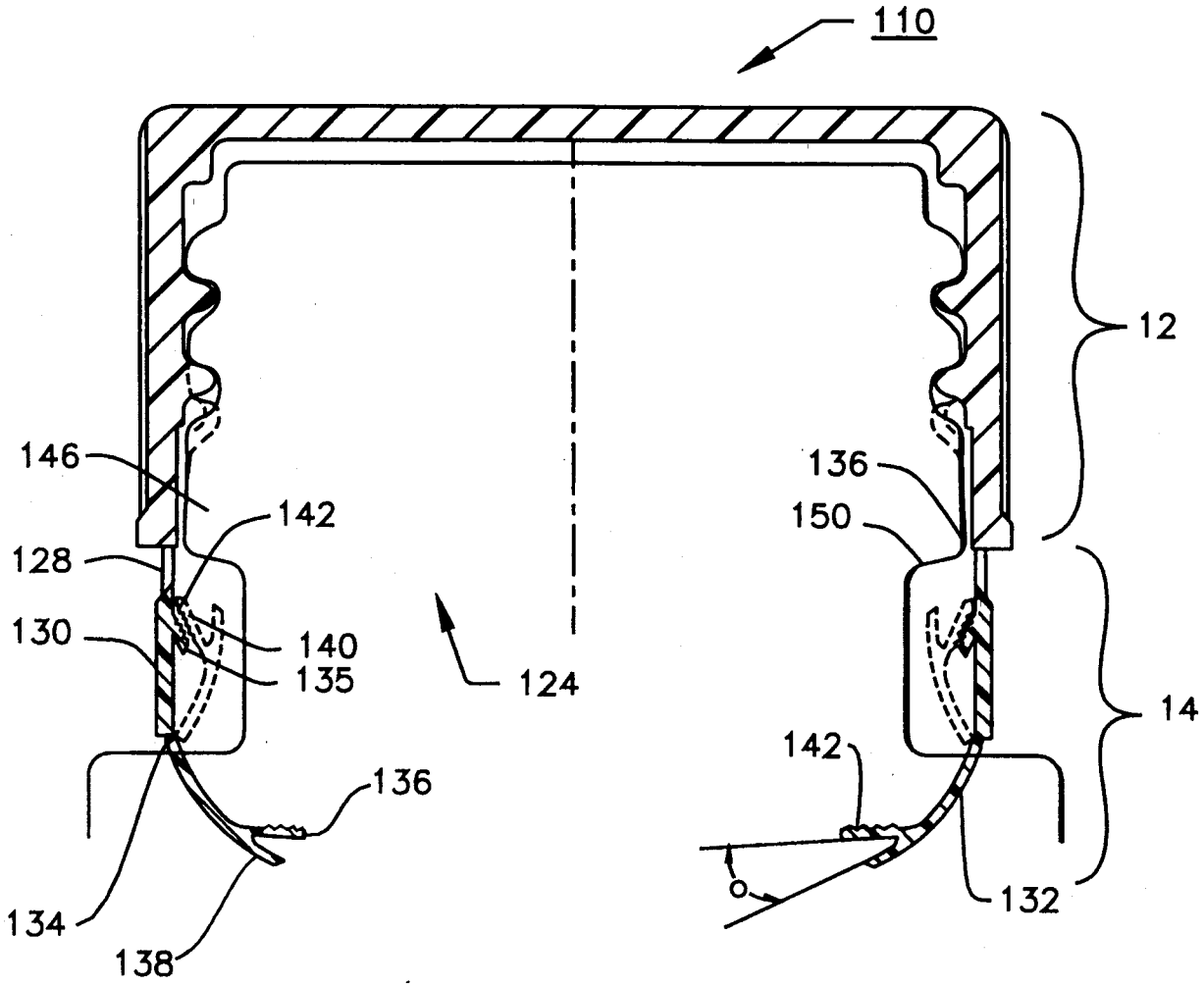
FIG. 3 shows a cross sectional view of a second preferred embodiment of the present invention closure.

Referring to FIG. 3, there is shown a second preferred embodiment of a closure 110 according to the present invention. In the embodiment of FIG. 3, the same reference numerals plus 110 are used for corresponding pans. In a similar fashion to the embodiment shown in FIGS. 1 and 2 the closure 110 comprises a cap member 112 and a band portion 114 interconnected by frangible link or bridge elements 128. Note that the dotted lines represent the band portion 114 as it is attached to the container 124.

The band portion 114 includes an annular band 130 and an annular flap 132. Located on the central interior portion of the annular band 130 is a downwardly extending protrusion 135 having ratchet teeth or saw teeth 142 on the top surface thereof. The annular flap 132 has a first leg 136 and a second leg 138, the first leg 136 having ratchet teeth or saw teeth 140 which correspond to the protrusion 135 and teeth 142 of the annular band 130. The annular flap 132 is adapted to fold upward along hinge line 134 when the closure 110 is attached to container 124 as in the previous embodiment.

Upon an attempt to tamper with the closure 110 or removal of the cap area 112, the second leg of the flap 132 will abut against the underside 150 of the peripheral bead 146. The underside 150 of the bead 146 will prevent advancement by the second leg 138 of the annular flap 132. At the same time the ratchet teeth 140 on the first leg 136 of the annular flap 132 will engage the corresponding ratchet teeth 142 on the protrusion 135 of the annular band 130. Upon removal of the closure 110 from the container 124 the pressure exerted by the engagement of the ratchet teeth 140, 142 from the band and flap will sever the bridge elements 128 causing the band portion 114 to detach from the cap member 112. Since the annular band 130 now includes protrusion 135 on its inner surface, the first leg 136 (of the Y-structure) of the annular flap 132 may be oriented at a less severely sloping angle $\theta$ than in the previous embodiment. This allows for a wider range of container tolerances to be covered by the instant embodiment, since a greater number of ratchet teeth 140, 142 can be provided on each of the surfaces.

Figure 4:
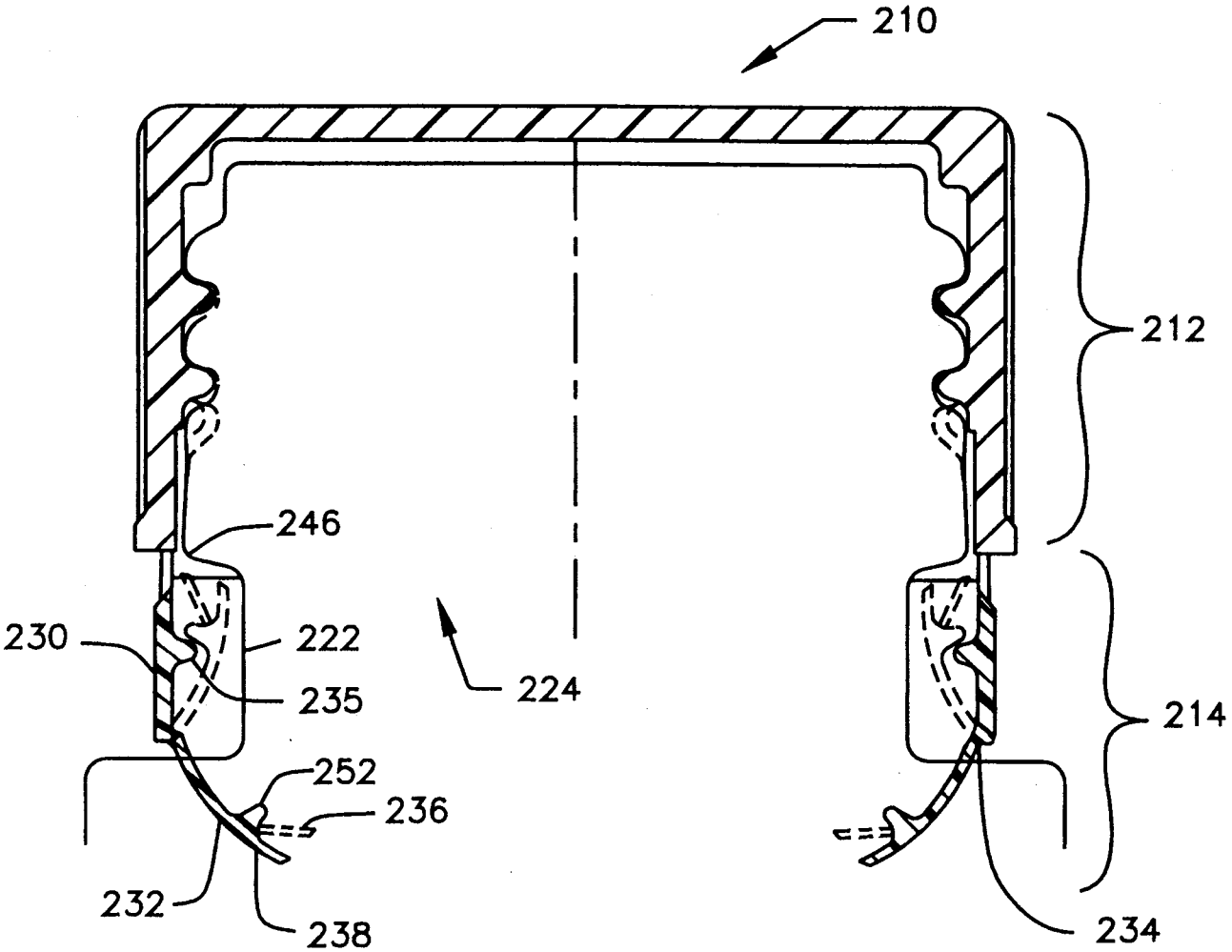
FIG. 4 shows a cross-sectional view of a third preferred embodiment of the present invention closure.

Referring to FIG. 4, there is shown a third preferred embodiment of the present invention closure wherein the same reference numerals plus 200 are used to identify corresponding parts. As in the previous two embodiments, the closure 210 includes a cap member 212 and a band portion 2 14. Similarly, the band portion includes an annular band 230 and an annular flap 232. The annular band 230 includes a projection 235 extending from the interior mid-portion thereof. The annular flap 232 is hingedly connected at hingeline 234 of the annular band 230 and is adapted to engage a peripheral bead 246 on the neck 222 of the container 224 and flip upwardly upon attachment. The annular flap 232 resembles a Y-like structure having a first leg 236 and a second leg 238. In addition, the annular flap contains an outwardly facing extension bump 252 at the intersection of the first and second legs 236, 238 of the annular flap 232.

The projection 135 on the interior of the annular band 230 engages the extension bump 252 on the annular flap 232 when the band portion 214 is pried upward. This forces the annular flap 232 to bow and pull lower on the outer annular band 230 to draw it inward, thus making it difficult to expand the band portion 214 over the peripheral bead 246. The first and second legs 236, 238 of the Y-structure of the annular flap 232 operate in a similar fashion as discussed in regard to the embodiment shown in FIGS. 1 and 2. Accordingly, the present embodiment closure 210 makes it virtually impossible for the closure to be removed from the container 224 without severing the band portion 214 from cap member 212, thus indicating a potential tampering to the container. It will be understood that the two coacting protrusions 235, 252 of the present invention may also contain corresponding ratchet teeth which are adapted to engage the respective surfaces thereof. The present invention closure is suitable for all types of containers having a threaded neck and extending peripheral bead, including plastic and glass. The closure is also particularly well suited to the wide-mouth containers which are presently being marketed.

From the above, it should be understood that the embodiment described, in regard to the drawings, is merely exemplary and that a person skilled in the art may make variations and modifications to the shown embodiment Without departing from the spirit and scope of the invention. All such variations and modifications are intended to be included within the scope of the invention as defined in the appended claims.

What is claimed is:

1. A tamper indicating closure for attachment to a container having a mouth and a neck with a peripheral bead, said closure comprising:

a cap member having a top portion including sealing means and a depending peripheral skin;

a tamper indicating member joined to said cap member by weakened frangible elements, said tamper indicating member including an annular band having an inner surface and a bottom edge;

an annular flap joined to said annular band at said bottom edge, said annular flap being upwardly and inwardly foldable upon attachment to said container;

variable engagement means located on said annular flap and said inner surface of said annular band for selectively interlocking said flap to said band at one of multiple settings, whereby said flap abuts against an underneath portion of said peripheral bead and said flap and band interlock forcing said tamper indicating band to sever from said cap member upon removal of said closure from said container.

2. The closure of claim 1, wherein said variable engagement means include a plurality of corresponding ratchet teeth on said annular band and said annular flap.

3. The closure of claim 1, wherein said annular band includes a circumferential protrusion having said variable engagement means located thereon.

4. The closure of claim 1, wherein said annular band includes a series of tabs equally spaced about the circumference thereof.

5. The closure of claim 1, wherein said closure includes means for securably fastening said closure to said container.

6. The closure of claim 5, wherein said container includes a neck with a threaded finish, an interior surface of said depending skin including threads for interengaging said threaded finish of said container.

7. The closure of claim 1, wherein said annular flap is Y-shaped in its transverse cross section having a first leg and a second leg, said second leg being extendable radially outward underneath said peripheral bead upon final attachment of said closure to said container.

8. The closure of claim 7, wherein said first leg is dimensioned so as to be interposed between a lower interior edge of said peripheral skirt and an outer edge of said peripheral bead upon attachment of said closure, thereby creating a wedge effect offering resistance to said first leg when said closure is removed.

9. The closure of claim 1, wherein said sealing means includes a downwardly projecting annular bead and an annular hooked flange concentrically located within said annular bead, said annular bead adapted to coact with an outer peripheral edge of the mouth of said container to form an outer seal and said hooked flange adapted to engage an inner ledge of said mouth of said container to form an inner seal, wherein a predetermined constant pressure range is maintained within said container such that said hooked flange is operable to break said inner seal when said predetermined pressure range is exceeded, whereby any release of pressure is dissipated in a chamber region between said inner and outer seal, thereby creating a back pressure on said hooked flange to reform said inner seal.

10. The closure of claim 1, wherein said cap member includes a knurled exterior surface.

11. The closure of claim 1, wherein said frangible elements include a plurality of bridge elements.

12. A tamper indicating closure for attachment to a container having a mouth and a neck with a peripheral bead, said closure comprising:

a cap member having a top portion including sealing means and a depending peripheral skin;

a tamper indicating member joined to said cap member along weakened frangible elements, said tamper indicating member including an annular band having a lower edge and an annular flap hingedly connected to said annular band at said lower edge, said annular flap having a first leg and a second leg, said annular flap being foldable radially inward and upwardly upon engagement of said closure with said neck of said container, wherein said first leg of said flap proximate said interior surface of said annular band includes engagement means adapted to engage corresponding engagement means on said annular band, said second leg being extendable radially underneath said peripheral bead upon final attachment of said closure, whereby said second leg of said annular flap abuts the underside of said peripheral bead and said engagement means on said annular band and said annular flap engage one another upon removal of said cap member, causing said tamper indicating member to sever from said cap member upon removal of said closure from said container.

13. The closure of claim 12, wherein said engagement means include a plurality of corresponding ratchet teeth on said annular band and said annular flap.

14. The closure of claim 12, wherein said first leg is dimensioned so as to be interposed between a lower interior edge of said peripheral skin and an outer edge of said peripheral bead upon attachment of said closure, thereby creating a wedge effect offering resistance to said first leg when said closure is removed.

15. The closure of claim 12, wherein said engagement means includes a circumferential rounded protrusion extending from an interior surface of said annular band and a corresponding rounded protrusion extending from said annular flap.

16. The closure of claim 12, wherein said sealing means includes a downwardly projecting annular bead and an annular hooked flange concentrically located within said annular bead, said annular bead adapted to coact with an outer peripheral edge of the mouth of said container to form an outer seal and said hooked flange adapted to engage an inner ledge of said mouth of said container to form an inner seal, wherein a predetermined constant pressure range is maintained within said container such that said hooked flange is operable to break said inner seal when said predetermined pressure range is exceeded, whereby any release of pressure is dissipated in a chamber region between said inner and outer seal, thereby creating a back pressure on said hooked flange to reform said inner seal.

17. The closure of claim 12, wherein said annular band includes a circumferential protrusion having said engagement means located thereon.

18. The closure of claim 12, wherein said annular band includes a series of tabs equally spaced about the circumference thereof.

19. The closure of claim 12, wherein said annular band is Y-shaped in its transverse cross section.

20. The closure of claim 12, wherein said cap member includes a knurled exterior surface.

21. The closure of claim 12, wherein said frangible elements include a plurality of bridge elements.

* * * * *